United States Patent [19]

Fukuchi et al.

[11] Patent Number: 4,559,898

[45] Date of Patent: Dec. 24, 1985

[54] DEVELOPING UNIT

[75] Inventors: Masakazu Fukuchi; Keiji Oishi; Yasuyuki Iwai, all of Hachioji, Japan

[73] Assignee: Konishiroku Photo Industry Co., Ltd., Tokyo, Japan

[21] Appl. No.: 435,614

[22] Filed: Oct. 20, 1982

[30] Foreign Application Priority Data

Oct. 26, 1981 [JP] Japan ..... 56-160083[U]

[51] Int. Cl.[4] ..... G03G 15/08

[52] U.S. Cl. ..... 118/653; 118/658

[58] Field of Search ..... 118/657, 658

[56] References Cited

U.S. PATENT DOCUMENTS 4,026,241 5/1977 Takebe ..... 118/658 X

*Primary Examiner*—Bernard D. Pianalto

*Attorney, Agent, or Firm*—Jordan B. Bierman

[57] ABSTRACT

The present invention relates to developing unit for an electrostatic reproducing apparatus, and more particularly to the developing unit comprising a developer mixing device thereof by which the developer is mixed up inside the developing unit in order to develop an electrostatic latent image.

9 Claims, 5 Drawing Figures

DEVELOPING UNIT

DESCRIPTION OF THE PRIOR ART

FIG. 1 is a cross-sectional view of a conventional developing unit to be used in a dry-type electrostatic reproducing apparatus. The explanation thereof will follow at first. Referring to the drawing, numeral 1 designates a photosensitive drum in which a photoreceptor on the circumferential surface of the drum is rotated clockwise with bearing thereon an electrostatic latent image and said latent image is developed in a developing section. Inside a developing chamber 2, there are arranged rotatably with both of a developing sleeve 3 and a developer mixing device 4. A developer D comprising a toner and a magnetic carrier is mixed up inside the developing chamber 2 by the clockwise rotation of the developer mixing device 4 and the toner and the carrier are thus adhered to each other by a frictional charge. Because of the arrangement of fixed magnets 5 inside the developing sleeve 3, the magnetic carrier adhered with the toner is adsorbed to the surface of the developing sleeve 3 by the magnetic force and are then carried upward with the counterclockwise rotation of the developing sleeve 3 (in FIG. 1). A developer layer regulating blade 6 provided to the vicinity of the developing sleeve 3 is to regulate the quantity of the developer adhered and conveyed to the developing sleeve 3. The developer whose quantity thus regulated thereby is carried onto the photoreceptor 1 to come into contact with an electrostatic latent image thereon and then the toner adheres to said electrostatic latent image and thus the development is completed in the processes as mentioned above. The developer is returned to the developing chamber from after every development process is completed. Thus, developer D performs developments as it is circulated in the developing chamber 2, but toner is consumed during such a circulation process, so that the toner density in the developer will be lowered and a development will consequently be deteriorated unless the toner is replenished. To cope therewith, a device for detecting a toner density which is not shown in the figure is provided with the developing chamber to detect toner density, and when the toner density is lowered to below a given level the toner is replenished by the rotation of a toner replenishing screw 7 in a toner supplying device to maintain the toner density of the developer constant, and a development is processed properly and at any time.

In this case, the developer mixing device is to operate both to keep the toner density of a developer uniform with mixing up the developer and toner to be replenished therein and to frictionally charge the toner and the magnetic carrier by the mixing action thereof. Referring now to such a mixing action, while rotating the mixing device the developer is mixedly transferred to the direction of the vector sum comprising a vector to mixedly transfer the developer to the rotating direction at right angles to the rotating shaft of the mixing device (hereinafter referred simply to as the rotating direction) and another vector to mixedly transfer the developer to the direction of the rotation of the rotating shaft thereof.

FIG. 2 shows a conventional developer mixing device having so far been used. FIG. 2(*a*) shows a mixing device with elliptical mixing blades; FIG. 2(*b*) shows that with spiral mixing blades; and FIG. 2(*c*) shows that with wind-mill shaped mixing blades. Those mixing devices may mix up toner and carrier but have the following defects. The elliptical mixing blades shown in FIG. 2(*a*) are mounted slantwise to a rotating shaft with a plurality of elliptical disc plates which may manage to mix up in the rotating direction, scanty as it is though, and in contrast therewith the mixing performance in the rotating direction at right angle to the rotating shaft is inferior. The spiral mixing blades shown in FIG. 2(*b*) are mounted with the blades spiralwise to the rotating shaft, whereby the mixing in the direction of the rotating shaft may be possible but the mixing in the direction of the rotation is almost impossible. The wind-mill shaped blades shown in FIG. 2(*c*) are mounted with a plurality of the radial blades, whereby developer may be scattered in the direction of the rotation, but the mixing function in the direction of the rotating shaft does not perform at all.

SUMMARY OF THE INVENTION

The present inventor has devoted himself to various studies on the developer mixing devices, and has discovered the fact that the mixedly transferring actions in both directions of the rotation and the rotating shaft will perform not only the simple mixing and frictional charging of toner and carrier but also the following operation. As is shown in FIG. 1, the mixing and transferring of developer in the rotating direction of the developer mixing device will also display an effect of newly supplying frictionally charged developer to developing sleeve 3, and on the other hand, the mixing and transferring of developer in the direction of the rotating shaft will display such a mixing effect that developer will become uniform in the toner density in the longitudinal direction of the developing sleeve 3. For example, the toner supplying by means of the toner supplying screw 7 as shown in FIG. 1 is to supply new toner in such a way that, as the new toner is being transported by a spiral screw from the faces of the Figure to the back side thereof, the new toner is almost uniformly dropped to the longitudinal direction of the developing sleeve 3 from a supplying opening provided to a portion of a pipe 8 covering the screw. Thereby, it is however difficult to supply toner properly and uniformly. Also, in the case that a large sized paper is copied after a smaller sized paper was continuously copied, there are instances where the image density is lowered in such an area where the toner density was lowered correspondingly to the area of the smaller sized paper previously copied. The lack of such a toner density uniformity caused over the longitudinal direction of the developing sleeve 3 may be recovered by the mixing and the transferring of the toner to the direction of the rotating shaft.

It is an object of the present invention to improve the conventional types of mixing devices having both advantages and disadvantages, and more particularly to provide a developing unit comprising a miniaturized and low-cost developer mixing device capable of displaying an efficient performance of mixing and transferring developer in both directions of the rotation and of a rotating shaft attached said mixing device.

The object of the present invention may be accomplished with a developing unit comprising a developer mixing device providing with a polyhedral rotator, a rotating shaft fitted with said polyhedral rotator, a primary mixing means transferring a developer to be mixing in the rotating direction, and a secondary mixing means transferring said developer in the direction of the rotating shaft and said mixing devices are fitted with the rotator and mixing devices may be rotating with said rotator.

DETAILED DESCRIPTION OF THE PREFERRED EMBODIMENT

Figure 1:
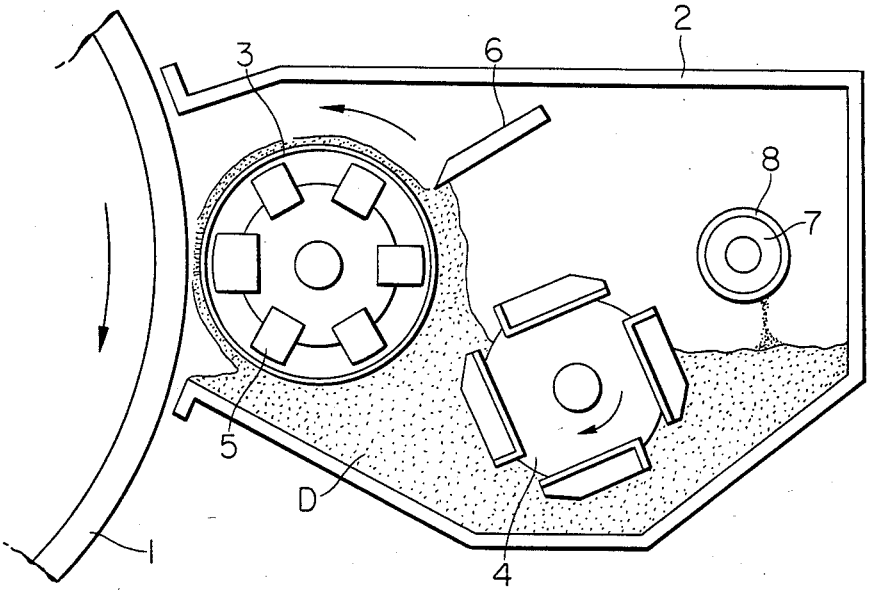
FIG. 1 shows a cross-sectional view of a developing unit.
Figure 2A:
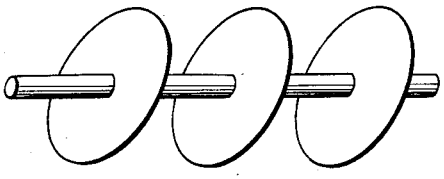
FIGS. 2A–2C show a developing unit having conventional developer mixing device.
Figure 2B:
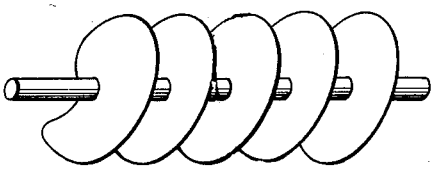
Figure 2C:
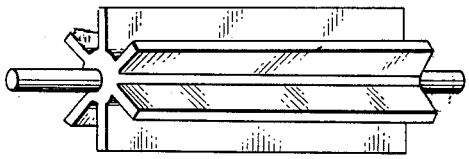
Figure 3:
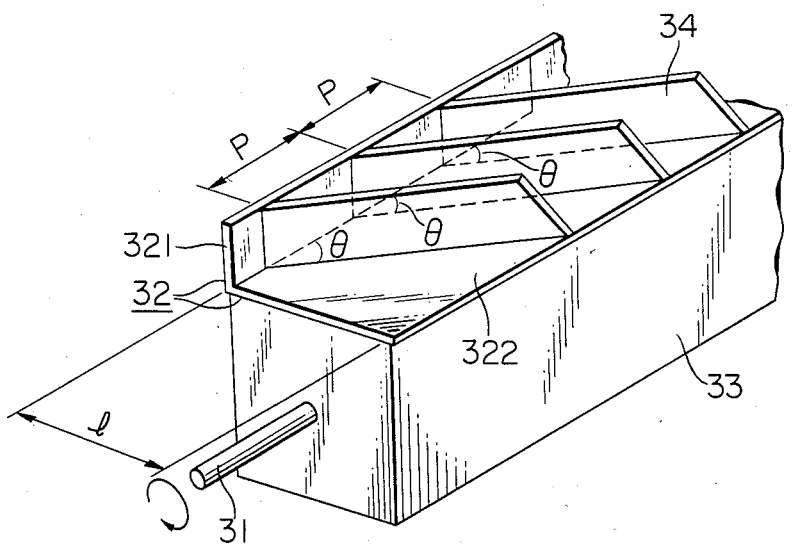
FIG. 3 shows a perspective view of an example embodied developer mixing device of the present invention.

FIG. 3 is a perspective view of an example of the present invention, wherein a square column 33 is made so that, centering a rotating shaft 31 that rotates in the direction of the arrow, one face 322 of L-shaped primary mixing device 32 is made as one of the side faces of the column 33 and the length l as one of the sides thereof, and further a plurality of wing-shaped secondary mixing device 34 are provided onto the primary mixing device 32 so that said secondary device can be arranged to make an inclination angle of $\theta$ and to space the wings at pitch p.

A rising member 321 of the primary mixing device 32 has a face parallel to the rotating shaft 31, therefore, when the shaft 31 rotates in the direction of the arrow, the rising member 321 pushes developer in front of the rising member 321 in the rotating direction and thus the developer is mixed up and transferred.

On the other hand, the secondary mixing device 34 will not apply a motive power in the direction of the rotating shaft to developer when the inclination angle $\theta=90°$ but a component of the power in the direction of the rotating shaft is generated as the inclination angle is becoming narrowed, and thus, when $\theta \approx 45°$, the maximum mixing and transferring performance can be displayed in the direction of the rotating shaft.

The developer mixing device of the present invention was embodied so as to comprise the primary mixing device 32 having the mixing and transferring performance in the rotating direction and the secondary mixing device 34 having the mixing and transferring performance in the direction of the rotating shaft, both of which were united in a body. Accordingly, the developer mixing device of the present invention has been successful to solve the defects of the conventional types of the devices, because the primary and secondary mixing devices 32 and 34 were simultaneously performed in operation by rotating the rotating shaft 31, and consequently the mixing-up of toner replenished and developer may be uniformly carried out over the direction of the rotating shaft and the newly mixed-up developer was transferred to a developing sleeve 3 at the same time.

On the other hand, if every secondary mixing device 34 mounted on the four faces of the square column 33 has the mixing and transferring performance in the same direction of the rotating shaft, then the gathering of the developer will cause to be lack of the uniformity, and in more serious case thereof, any development cannot be made uniformly in the longitudinal direction of the developing sleeve 3. It is therefore required to compose the rotating wings of secondary mixing device 34 of the combination of the wings in one direction and the other wings in the opposite direction so that most of the developer may not be in a cluster in one direction only.

Further, in this example, the rotating blades were made in a united square column in a body by molding or the like, however, the invention shall not be limited thereto. The rotating blades on a hexagonal column have incidentally been experimented and have produced an excellent mixing effect.

What is claimed is:

1. In a device for mixing developer for an electrostatic latent image recorder comprising a shaft adapted to rotate in a first direction around its axis, a body fixed around said shaft to rotate therewith and at least one mixing blade fixed on said body, the improvement wherein said body has faces defining a polygonal cross section, said mixing blade comprises at least one primary mixing member which is capable of moving said developer in said first direction, a secondary mixing member capable of moving said developer in a second direction which is parallel to said axis, and a tertiary mixing member adapted to displace said developer in a third direction which is parallel to said axis and opposite said second direction, said secondary and said tertiary members being angularly disposed to said primary member at an angle other than 90°, and said secondary mixing member and said tertiary mixing member being arranged alternately on said body in the rotating direction of said body.

2. The device of claim 1 wherein said primary mixing members are disposed on every face of said body.

3. The device of claim 1 wherein said primary and secondary members are affixed to said sides of said body.

4. The device of claim 3 wherein said polygonal cross-section is a square.

5. The device of claim 3 wherein said polygonal cross-section is a hexagon.

6. The device of claim 3 wherein said mixing blade further comprises at least one tertiary mixing member adapted to displace said developer in a third direction which is parallel to said axis and opposite said second direction, said tertiary member being affixed to a face which is different from that to which said secondary members are affixed.

7. In a device for mixing developer in an electrostatic latent image recorder comprising a shaft adapted to rotate in a first direction around its axis, a body fixed around said shaft to rotate therewith, and at least one mixing blade on said body, the improvement comprising said body having faces which define a polygonal cross-section, said mixing blade being at least one primary mixing member capable of moving said developer in said first direction and at least one secondary mixing member capable of moving said developer in a second direction which is parallel to said axis, at least one of said primary members and at least one of said secondary members being affixed to at least one of said sides and, when on the same face, forming an angle greater than 0° and less than 90° with said primary mixing members whereby, when said shaft rotates, said secondary members precede said primary members.

8. The device of claim 7 wherein said mixing blade further comprises tertiary mixing members adapted to move said developer in a third direction parallel to said axis and opposite said second direction, and at least one said primary member and at least one of said tertiary members are affixed to at least one of said forces and form an angle greater than 90° and less than 180° with said primary member, provided that said tertiary members are not affixed to the same face as said secondary members.

9. In a mixing device for mixing solids comprising a shaft adapted to rotate in a first direction around its axis, a body fixed around said shaft to rotate therewith, and at least one mixing blade on said body, the improvement comprising said body having faces which define a polygonal cross-section, said mixing blade being at least one primary mixing member capable of moving said solids in said first direction and at least one secondary mixing member capable of moving said solids in a second direction which is parallel to said axis, some of said primary members and some of said secondary members being affixed to the same faces and, when on the same face, forming an angle greater than 0° and less than 90° with said primary mixing members whereby, when said shaft rotates, said secondary members precede said primary members.

* * * * *